US010718589B2

(12) United States Patent
Zou

(10) Patent No.: US 10,718,589 B2
(45) Date of Patent: Jul. 21, 2020

(54) MULTI-SHOT CROSSBOW

(71) Applicant: Dongshi Zou, Jilin (CN)

(72) Inventor: Dongshi Zou, Jilin (CN)

(73) Assignee: Dongshi Zou, Jilin (CN)

( * ) Notice: Subject to any disclaimer, the term of this patent is extended or adjusted under 35 U.S.C. 154(b) by 0 days.

(21) Appl. No.: 16/445,078

(22) Filed: Jun. 18, 2019

(65) Prior Publication Data

US 2019/0331453 A1 Oct. 31, 2019

Related U.S. Application Data

(63) Continuation of application No. PCT/CN2019/085488, filed on May 5, 2019.

(30) Foreign Application Priority Data

Apr. 10, 2018 (CN) ..... 2018 1 0316643

(51) Int. Cl.
*F41B 5/12* (2006.01)

(52) U.S. Cl.
CPC ..... *F41B 5/126* (2013.01)

(58) Field of Classification Search
CPC ..... F41B 5/12; F41B 5/126; F41B 5/1469
USPC ..... 124/25, 25.5, 86
See application file for complete search history.

(56) References Cited

U.S. PATENT DOCUMENTS 28,698 A * 6/1860 Stevens ..... F41B 5/126 124/25
320,643 A * 6/1885 Engle ..... F41B 5/126 124/26
918,444 A * 4/1909 Griffith ..... F41B 5/126 124/21
1,985,079 A * 12/1934 Conklin ..... F41A 9/24 124/25
2,516,341 A * 7/1950 Raffeis ..... F41B 5/126 124/49
2,554,966 A * 5/1951 Stevens ..... F41B 5/12 124/25

(Continued)

FOREIGN PATENT DOCUMENTS

CN 203744826 U 7/2014
CN 203928873 U 11/2014
CN 204678962 U 9/2015

*Primary Examiner* — Alexander R Niconovich
(74) *Attorney, Agent, or Firm* — Wayne & Ken, LLC; Tony Horn

(57) ABSTRACT

A multi-shot crossbow includes a crossbow arm, bowstrings, and a crossbow body, wherein the crossbow arm is provided with a slider which is slidably connected with the crossbow arm along a longitudinal direction of the crossbow arm, a top of the crossbow arm is fixed with an arrow chamber which is provided with a plurality of longitudinally extending arrow holes, each of the arrow holes is provided with a slidably connected hammer, each hammer is fixedly connected to the slider, the bowstrings are located below the crossbow arm, and when the slider is at a back end point, the slider is movably attached to the crossbow body. Multiple arrows can be simultaneously shot, and the hammers can be arranged side by side and can shoot all the arrows at the same time. All the arrows are evenly driven and are shot with small radius and high hit accuracy.

9 Claims, 8 Drawing Sheets

(56) References Cited

U.S. PATENT DOCUMENTS 2,918,050 A * 12/1959 Kopman ..... F41B 5/12 124/25
3,125,998 A * 3/1964 Stevens ..... F41B 5/126 124/25
3,561,419 A * 2/1971 Cucuzza, Sr. ..... F41B 5/12 124/25
3,739,765 A * 6/1973 Moore ..... F41B 5/12 124/25
3,968,783 A * 7/1976 Pfotenhauer ..... F41B 5/126 124/25
4,565,182 A * 1/1986 Barnett ..... F41B 5/126 124/25
4,662,345 A * 5/1987 Stephens ..... F41A 9/70 124/25
5,437,260 A * 8/1995 King ..... F41B 5/12 124/25
5,544,641 A * 8/1996 Jenn ..... F41B 5/12 124/25
6,095,128 A * 8/2000 Bednar ..... F41B 5/1469 124/25
6,868,845 B1 * 3/2005 Moore ..... F41B 5/126 124/25
7,753,041 B2 * 7/2010 Ogawa ..... F41B 5/12 124/25
7,784,453 B1 * 8/2010 Yehle ..... F41B 5/12 124/25
8,863,732 B1 * 10/2014 Prior ..... F41B 5/123 124/25
9,341,422 B2 * 5/2016 Rodich ..... F41A 9/73
9,513,075 B2 * 12/2016 Lallier ..... F41A 9/73
2008/0141989 A1 * 6/2008 Ogawa ..... F41B 5/12 124/25
2015/0233666 A1 * 8/2015 Rodich ..... F41B 5/126 124/25

* cited by examiner

MULTI-SHOT CROSSBOW

CROSS-REFERENCE TO RELATED APPLICATIONS

This application is a continuation of International Application No. PCT/CN2019/085488, filed on May 5, 2019, which claims priority from Chinese Patent Application No. 201810316643.5, filed on Apr. 10, 2018, both of which are hereby incorporated by reference in their entireties.

TECHNICAL FIELD

The present disclosure discloses a multi-shot crossbow.

BACKGROUND

Crossbow is a weapon used to shoot arrows. Crossbow is a kind of bow with an arm, and is mainly composed of a crossbow arm, a crossbow arch, a bowstring and a crossbow body. The crossbow bow is provided transversally to the front end of the crossbow arm. The crossbow arm is provided with an arrow groove, and the crossbow body is placed at the rear end of the arrow groove. The bowstring is located above the crossbow arm, the two ends of the bowstring are hooked on two crossbows, and the string is hung on the hook of the crossbow body. When shooting, the arrow is placed in the arrow groove, the hook is pulled open, the open crossbow is used to drive the bowstring to form a kinetic energy of rapid rebound, and the arrow is shot at a high speed. As recorded in the history, Zhugeliannu can shoot ten arrows at a time. Zhugeliannu is in a state of loss, and many people want to reproduce it. However, as to the existing imitated Zhugeliannu, the difference is only the number of arrow grooves on the crossbow arm, and the rest of the structure is roughly the same as the structure of the ordinary crossbow. Since after is string is hooked, the portions of the string on both sides of the hook are inclined at an angle, and thus the arrows within the arrow grooves on the two sides are shot first and the arrows within the arrow grooves in the middle are shot later. The kinetic energy of the bowstring is attenuated, resulting in a large spread radius of the arrows and low shooting accuracy. In order to ensure the initial velocity of the arrows, the existing stringer usually uses a bowstring of larger pounds to hit multiple arrows. However, it is difficult to get the string ready, the arrows need to be arranged in the arrow grooves one by one, the shooting interval is long, and repeated shooting is performed very slowly.

SUMMARY

The object of the present disclosure is to provide a multi-shot crossbow that can simultaneously shoot multiple arrows with high hit accuracy and fast shooting speed.

The technical solution of the present disclosure is to provide a multi-shot crossbow, comprising a crossbow arm (1), bowstrings (9), and a crossbow body, wherein the crossbow arm is provided with a slider (6) which is slidably connected with the crossbow arm along a longitudinal direction of the crossbow arm, a top of the crossbow arm is fixed with an arrow chamber (4) which is provided with a plurality of longitudinally extending arrow holes (3), each of the arrow holes is provided with a slidably connected hammer (5), each hammer is fixed to the slider, the bowstrings are located below the crossbow arm, and strings of the bowstrings are attached to the slider, and when the slider is at a back end point, the slider is movably attached to the crossbow body.

Further, the crossbow body has a wrench (20), a hook plate (16) and a spring (14), an upper portion of the wrench and a middle portion of the hook plate are each hinged on the crossbow arm through a shaft pin, an elastic end of the spring is crimped to the crossbow arm, and another elastic end of the spring is crimped to the wrench under the shaft pin, a rear end of the hook plate is movably attached to a middle portion of the wrench, when the slider is at the back end point, the slider is movably attached to a front end of the hook plate.

Further, the crossbow arm is provided with elongated through holes (22) in a longitudinal direction, and the slider is limited within the elongated through holes and slidably connected to the crossbow arm.

Further, the slider is slidably connected to the crossbow arm by a slideway (2), and the slideway is fixed to the crossbow arm.

Further, the arrow chamber has a base (26) which is provided with a plurality of longitudinally extending arrow grooves (25), a plurality of U-shaped arrow sheaths (27) are sequentially stacked on top of each arrow groove, a width of each arrow sheath is greater than a width of each corresponding arrow groove, a bottom surface of the arrow sheath of a lowermost layer and the corresponding arrow groove form each arrow groove, a front portion of a bottom surface of each arrow sheath is provided with a projection (33), a rear end of each hammer or slider is provided with a shaft lever (30), each shaft lever is provided with a hinged jacking plate (29), a rear end of each jacking plate under normal state is tilted up to be opposite to the projection of on the bottom surface of the corresponding arrow sheath, each of the arrow grooves is received in a bottom open box body (28), the box body is fixed on the base or the crossbow arm, a rear elevation of the box body is provided a plurality of U-shaped gaps (32) corresponding to a position of a section of the arrow sheath of the lowermost layer.

Further, a front end of a bottom portion of the crossbow arm is provided with an automatic wire spooler (38), a rear end of a bottom portion of the crossbow arm is provided with a reeling device (34), a pull wire (35) is provided between the automatic wire spooler and the reel, the pull wire is attached with a hook (37), and the hook is movably attached to the slider.

Further, the reeling device is an electric reel.

Further, the number of the arrow grooves is ten.

Further, a front end of the hammer is provided with a detachable hammer head (39).

The present disclosure has several advantages. Arrows are arranged in the arrow holes, the slider is moved by the bowstring, and the kinetic energy of the bowstring is used to shoot the arrows by the slider and the hammer. Multiple arrows can be simultaneously shot, and the hammers can be arranged side by side and can shoot all the arrows at the same time. All the arrows are evenly driven and are shot with small radius and high hit accuracy. The crossbow of the application is simple and stable. By limiting the slider through the elongated through holes, the tremor of the slider at the time of shooting can be eliminated, so that the hammer hits the arrow in a stabilized way, and the hit accuracy of the multi-shot crossbow is further improved. The slide can reduce the friction between the slider and the crossbow arm, which not only improves the hit accuracy of the multi-shot crossbow, but also saves effort. A plurality of arrow sheaths are arranged, and each arrow sheath is provided with an arrow. The jacking plate at the rear end of the slider abuts against the projection of the corresponding arrow sheath. When the slider is ready, the arrow sheaths can be withdrawn from the gap of the rear elevation of the box body, and thus the arrows in the arrow sheaths fall into the arrow grooves. After shooting, the above action is repeated, and the arrows can be quickly added to the arrow grooves, and the repeated shooting speed is extremely fast. Hanging the hook on the slider and using the reeling device to pull the bow can save labor, and using electric reeling device can further save physical strength and increase the speed of repeated shooting.

REFERENCE NUMERALS

Figure 1:
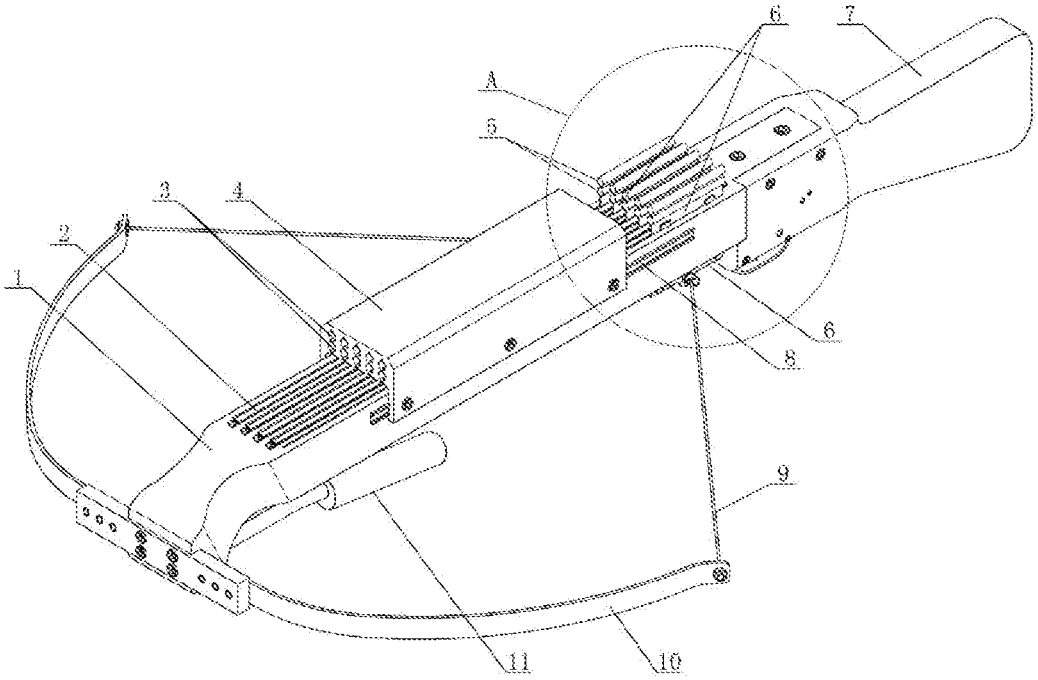
FIG. 1 is a schematic axial view of the multi-shot crossbow of the present disclosure.
Figure 2:
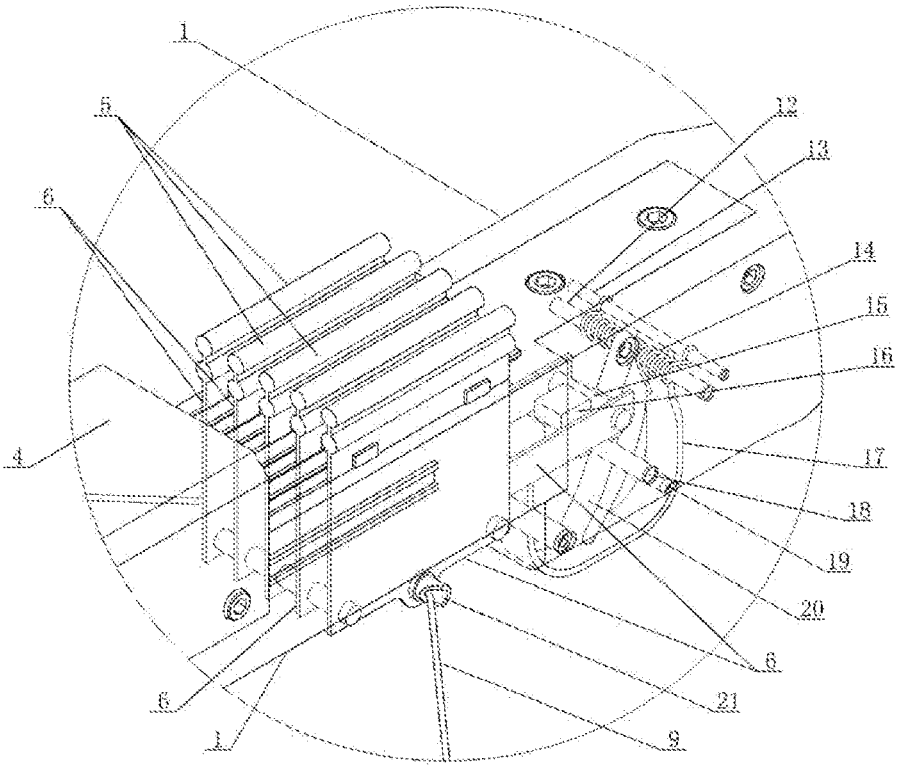
FIG. 2 is an enlarged perspective view of the portion A of FIG. 1.
Figure 3:
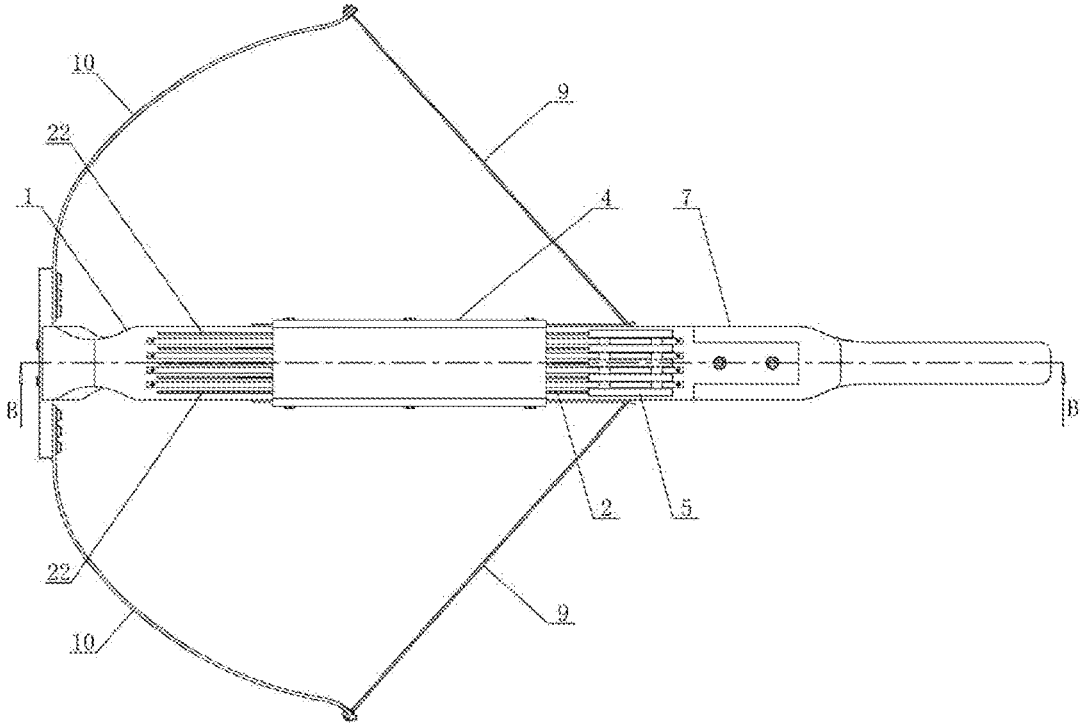
FIG. 3 is a schematic top plan view of FIG. 1.
Figure 4:
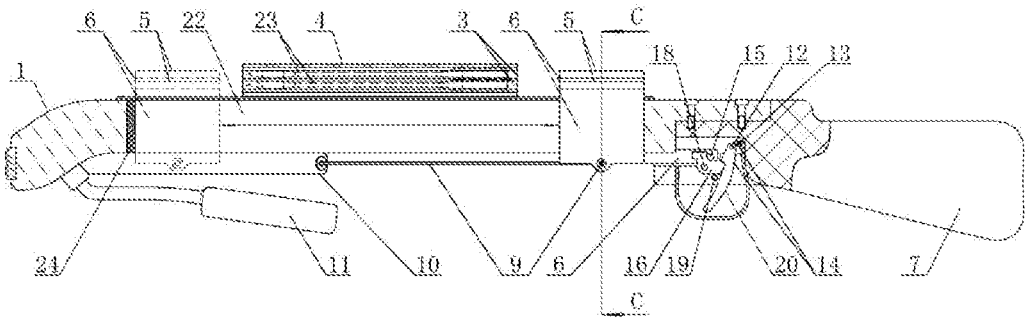
FIG. 4 is a schematic cross-sectional view taken along line B-B of FIG. 3.
Figure 5:
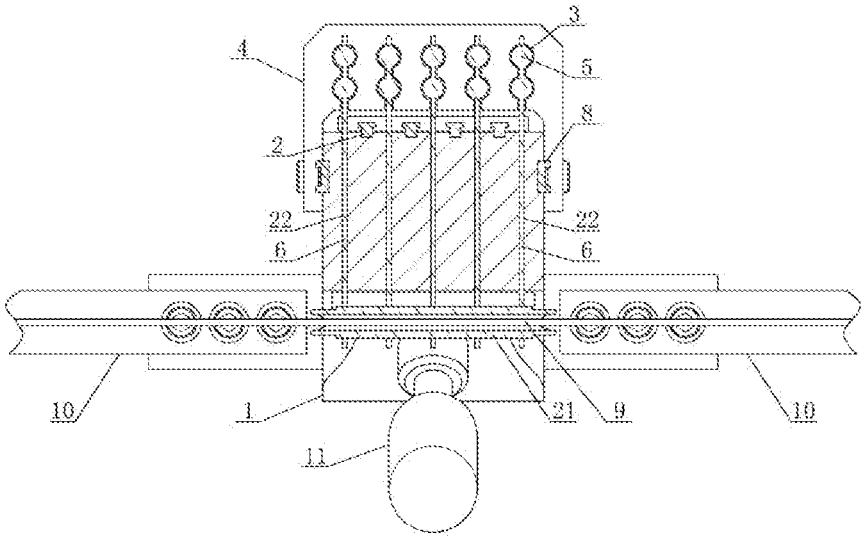
FIG. 5 is a schematic cross-sectional view taken along line C-C of FIG. 4.
Figure 6:
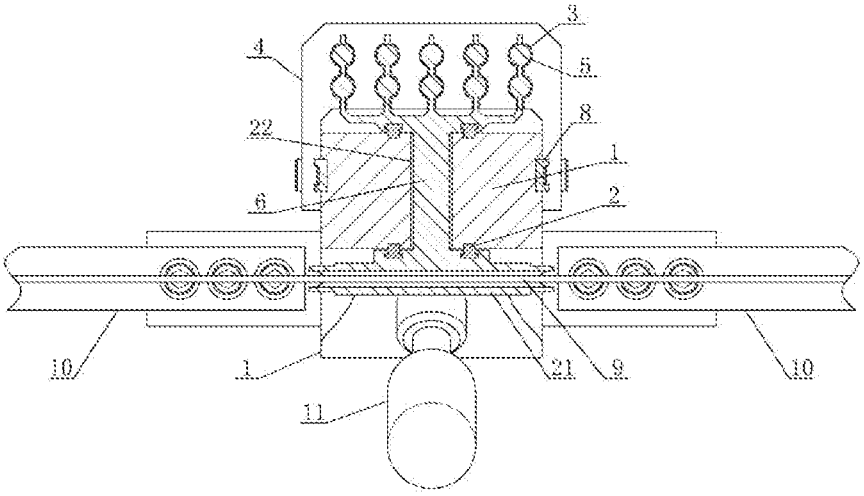
FIG. 6 is a schematic view showing another slider structure of the multi-shot crossbow of the present disclosure.

1 crossbow arm, 2 slider, 3 arrow groove, 4 arrow chamber, 5 hammer, 6 slider, 7 rear grip, 8 mounting rail, 9 string, 10 crossbow bow, 11 front grip, 12 wrench shaft pin, 13 spring shaft pin, 14 spring, 15 bolt lever, 16 hook plate, 17 retaining ring, 18 hook plate pin, 19 limit pin, 20 wrench, 21 threading tube, 22 elongated through hole, 23 arrow, 24 buffer block, 25 arrow groove, 26 base, 27 arrow sheath, 28 box body, 29 jacking plate, 30 shaft lever, 31 crank, 32 gap, 33 projection, 34 reel, 35 pull wire, 36 slider hanger, 37 hook, 38 automatic spooler, 39 hammer head, 40 reduction motor, 41 electric wire, 42 batteries.

DETAILED DESCRIPTION OF EMBODIMENTS

The multi-shot crossbow of the present disclosure is further illustrated below with reference to the accompanying drawings. The multi-shot crossbows shown in FIGS. 1 to 6 includes a crossbow arm 1, a crossbow arch 10, bowstrings 9, and a crossbow body. The crossbow arch is fixed at the front end of the crossbow arm, the rear end of the crossbow arm is provided with a rear grip 7, and the front end of the crossbow arm is provided with a front grip 11. A slider 6 is mounted on the crossbow arm, and the slider is slidably connected with the crossbow arm in the longitudinal direction. The top portion of the crossbow arm is fixed with an arrow chamber 4, a mounting rail 8 is arranged between the arrow chamber and the crossbow arm for facilitating the adjustment of the position of the arrow chamber and for quick replacement of the arrow chamber. The arrow chamber is provided with a plurality of longitudinally extending arrow grooves 3, each of which has a slidably connected hammer 5. The hammer is fixedly connected to the slider, and the arrow chamber is further provided with a longitudinal opening for giving a position between the hammer and the slider. The bowstring is located below the crossbow arm, the two ends of the bowstring are connected to the crossbow arch, and the string of the bowstring is attached to the slider. In this embodiment, a threading pipe 21 is fixedly connected to the lower side of the slider in a transverse direction, and the two ends of the threading pipe are provided with a forward chamfering angle, and the edge of the chamfering angle is treated to be blunt and smooth. The tension of the slider can be uniformed by the threading pipe, and the service life of the bowstring is improved. When the slider is at the back end point, it is movably attached to the crossbow body. At this time, an arrow 23 is placed in each arrow groove.

The slider is slidably connected to the crossbow arm through a slideway 2, and the slideway is fixed on the crossbow arm. The slideway adopts an I-shaped slideway or a T-shaped slideway, and grease or lubricating oil is applied between the slideway and the slider. Through use of the slide, the sliding resistance of the slider can be reduced.

The crossbow body can adopt the structure of the crossbow body in the prior art, and can also refer to the structure of the firearm type trigger assembly. In this embodiment, the crossbow body has a wrench 20, a hook plate 16, and a spring 14. The periphery of the outer wrench of the crossbow arm is provided with a retaining ring 17 which is fixed on the crossbow arm to avoid accidentally actuating the wrench and shooting the arrows. The upper part of the wrench is hinged to the crossbow arm by the wrench shaft pin 12, and the middle of the hook plate is hinged on the crossbow arm through the hook plate shaft pin 18. One elastic end of the spring is crimped with the crossbow arm, and the other elastic end is crimped with the wrench under the shaft pin. The rear end of the hook plate is hooked with the middle portion of the wrench. The slider is movably attached to the front end of the hook plate when the slider is at the back end point. The shape of the hook plate may be C-shaped or V-shaped or F-shaped according to the actual structure, and the hook plate in the embodiment is L-shaped. A limit pin 19 is arranged under the hook plate, so that the hook plate is hinged around the hook pin of the hook plate within the limit of the design distance. In order to facilitate attachment of the slider to the front end of the hook plate, the rear end of the slider is fixed with a bolt lever 15 which can push the hook plate to overturn backwards. When the hook plate is overturned, the front end of the hook plate is hung to the bolt lever, and the rear end is hooked by the wrench, that is, the string is ready. When shooting, the finger hooks the lower end of the wrench, and the wrench will be displaced around the hinge shaft of the wrench to unhook the hook plate. At this time, the slider will pull the hook plate under the traction force of the bowstring, separate from the hook plate, and displace at a high speed along the longitudinal direction. The hammer is driven to shoot the arrow in the arrow groove to complete the archery action. In the structure, the spring is a compression spring or a torsion spring, and is used for automatically resetting the wrench to automatically hook and lock the hook plate. In this embodiment, a torsion spring is used, and the torsion spring is sleeved on the wrench shaft pin. One elastic end of the spring is hung on the spring shaft pin 13 for limiting, and the other elastic end is attached on the rear end of the middle portion of the wrench to complete the reset.

As shown in FIG. 3 to FIG. 6, the crossbow arm is provided with elongated through holes 22 in the longitudinal direction, and the slider is limited to elongated through hole and slidably connected to the crossbow arm. The slider may also be formed by a plurality of sliding pieces arranged side by side, each sliding piece correspondingly has an elongated through hole. The sliding pieces located at the outer side of the crossbow arm are integrally fixed to each other, and the front end of the elongated through hole is installed with a buffer block 24 to relieve the impact force of the slider, avoiding the hard impact between the crossbow arm and the slider and improving the service life of the multi-shot crossbow. In this configuration, the hammer is connected to the crossbow arm from below. The longitudinal opening on the arrow chamber for giving position is located in the lower part of the arrow chamber.

Figure 7:
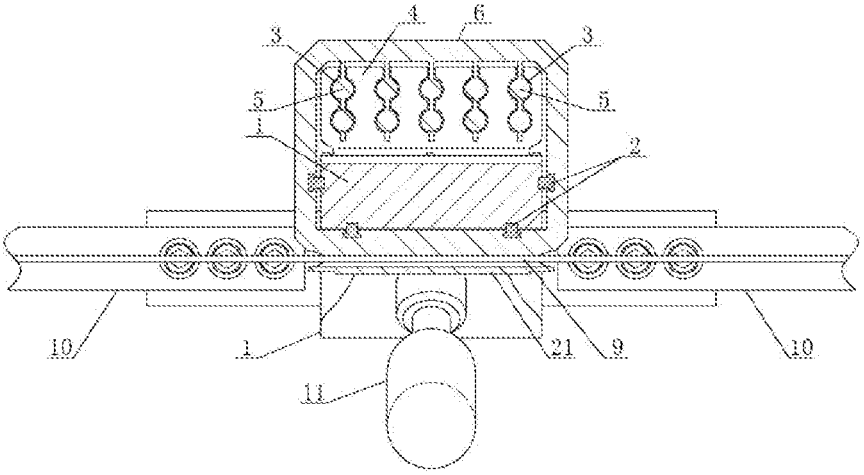
FIG. 7 is a schematic view showing still another slider structure of the multi-shot crossbow of the present disclosure.
Figure 8:
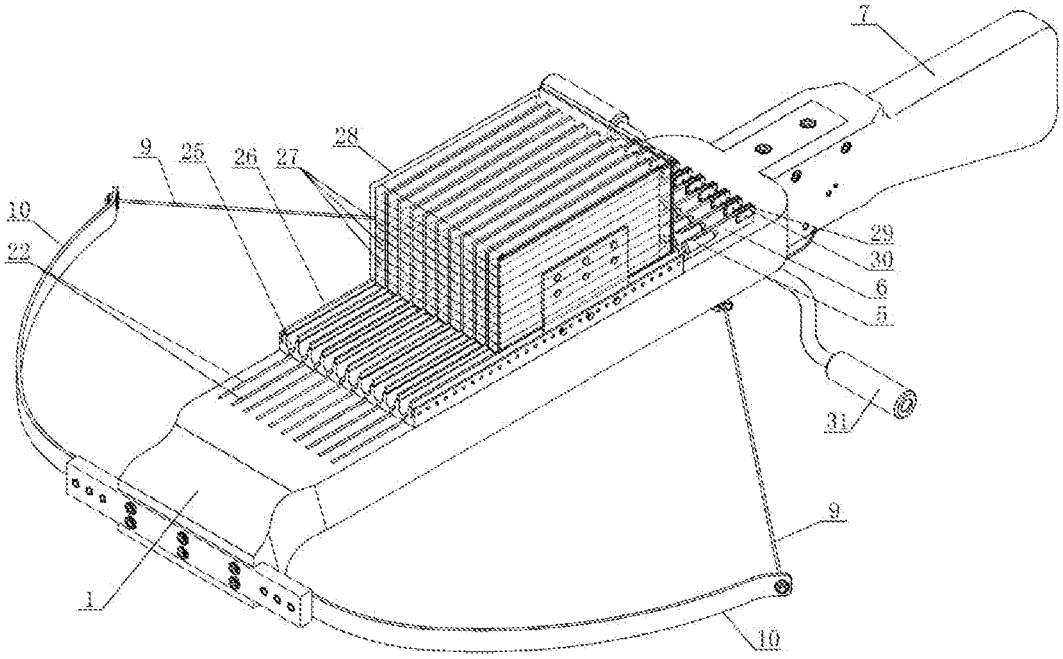
FIG. 8 is a schematic axial view of another multi-shot crossbow of the present disclosure.
Figure 9:
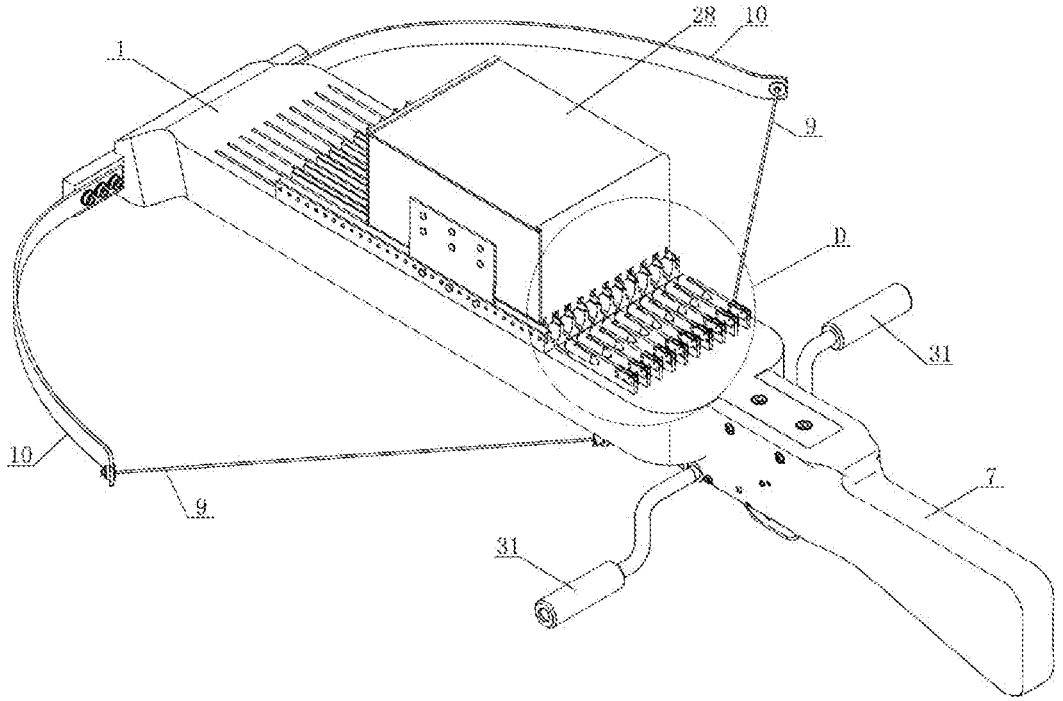
FIG. 9 is a left rear axial view of FIG. 8.
Figure 10:
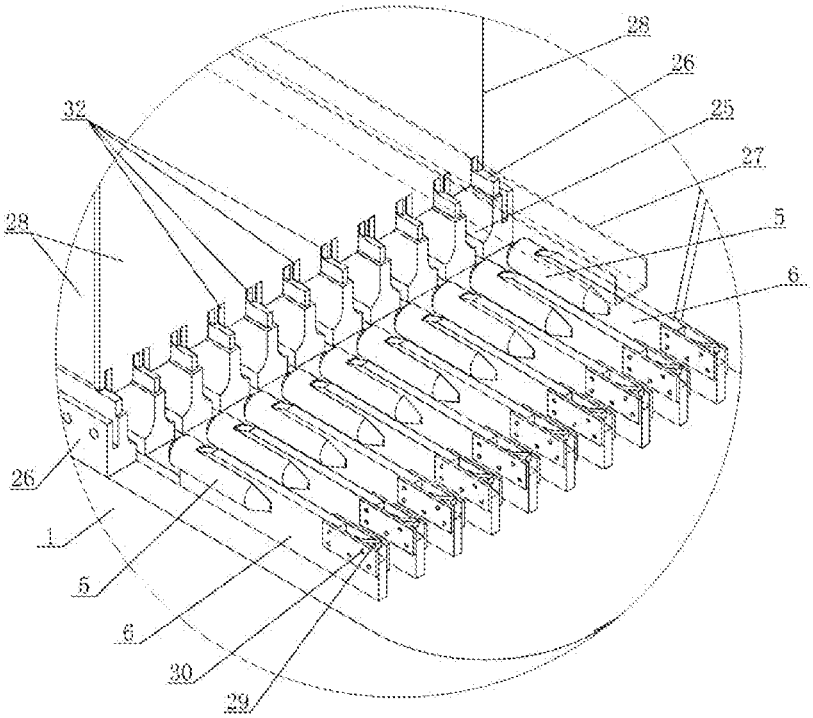
FIG. 10 is an enlarged schematic view showing a portion D of FIG. 9.
Figure 11:
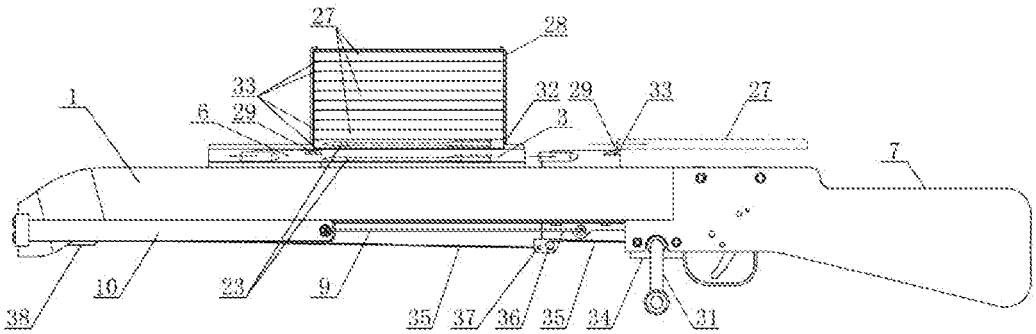
FIG. 11 is a front elevational and partial cross-sectional view of FIG. 8.
Figure 12:
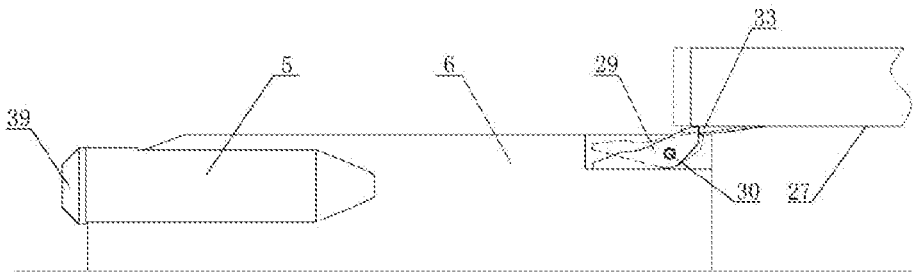
FIG. 12 is a schematic view showing the principle of operation of the jacking plate and the arrow sheath projection of FIG. 11.
Figure 13:
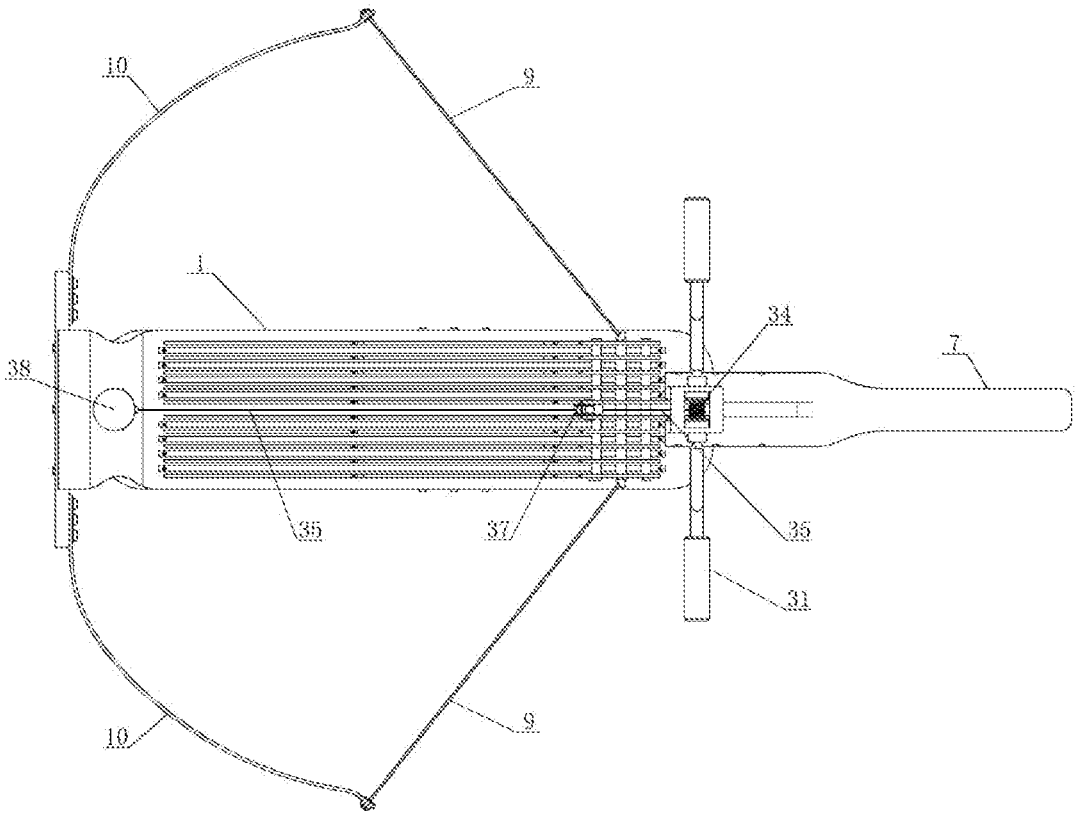
FIG. 13 is a bottom view of FIG. 11.

As shown in FIG. 7, the slider is annular and arranged around the crossbow arm and the arrow chamber. The slider is longitudinally slidably connected to the crossbow arm through the slideway. In the structure, the hammer is connected to the crossbow arm from above. The longitudinal opening on the arrow chamber for giving position is located in the upper part of the arrow chamber.

As shown in FIG. 8 to FIG. 14, the arrow chamber has a base 26 which is provided with a plurality of longitudinally extending arrow grooves 25, a plurality of U-shaped arrow sheaths 27 are sequentially stacked on top of each arrow groove, a width of each arrow sheath is greater than a width of each corresponding arrow groove, a bottom surface of the arrow sheath of a lowermost layer and the corresponding arrow groove form each arrow groove, a front portion of a bottom surface of each arrow sheath is provided with a projection 33, a rear end of each hammer or slider is provided with a shaft lever 30, each shaft lever is provided with a hinged jacking plate 29, a rear end of each jacking plate under normal state is tilted up to be opposite to the projection of on the bottom surface of the corresponding arrow sheath, each of the arrow grooves is received in a bottom open box body 28, the box body is fixed on the base or the crossbow arm, a rear elevation of the box body is provided a plurality of U-shaped gaps 32 corresponding to a position of a section of the arrow sheath of the lowermost layer.

Figure 14:
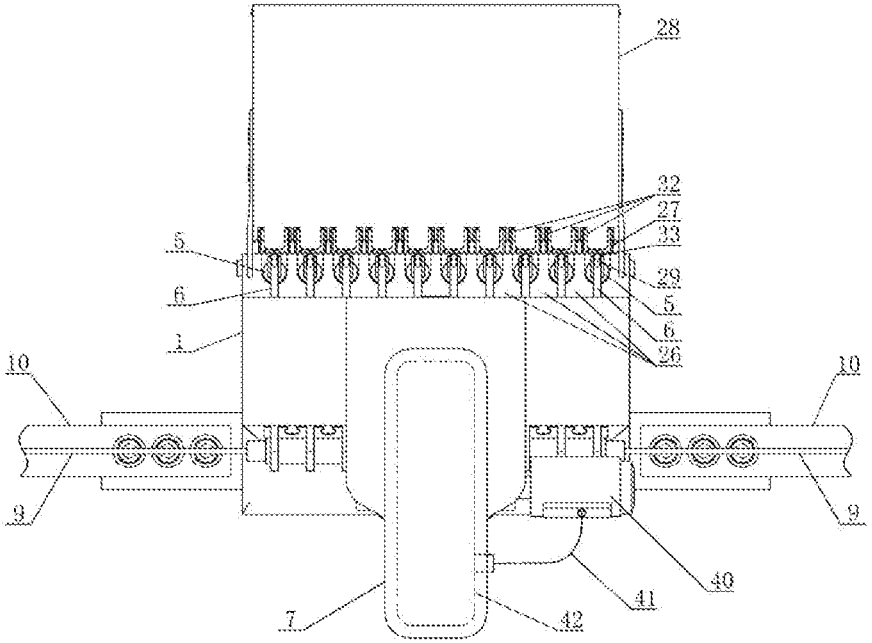
FIG. 14 is a schematic structural view of still another multi-shot crossbow.

In order to further improve the bowing efficiency and save manpower, a front end of a bottom portion of the crossbow arm is provided with an automatic wire spooler 38, a rear end of a bottom portion of the crossbow arm is provided with a reeling device 34, a pull wire 35 is provided between the automatic wire spooler and the reel, the pull wire is attached with a hook 37, and the hook is movably attached to the slider. According to this structure, in the embodiment, a slider hanger 36 is fixedly attached to the slider, and the hanger is used for slidable attachment of the hook on the slider, the hook opening on the hook is towards the rear, so that after the bowstring is ready, the rewinding function of the automatic spooler can be used for automatic disconnection from the slider hanger for resetting and preventing it from affecting the movement of the slider. The automatic spooler and the reeling device are commercially available products, and the working principle of the automatic spooler is similar to that of the tape measure, in which the wire is retracted by the spiral spring force. The reeling device generally has a wire roll, one end of the pull wire is fixed on the wire roll, and the wire is wound by rotating the wire roll to serve the purpose of winding. This embodiment exemplifies two kinds of reels, one is a manual cranked reeling device and the other is an electric reel. As to the manual cranked reel, the wire roll is mounted on the crossbow arm, a crank is provided on both sides of the wire roll, and the wire roll is driven by the rotating the crank 31 for winding. As shown in FIG. 14, the electric reeling device comprises a wire roll, a reduction motor 40 and a battery 42. The output shaft of the reduction motor is dynamically connected with the reel of the wire roll, the housing of the motor is fixed on the crossbow arm, the battery is a lithium battery and is installed in the rear grip, and the battery is electrically connected with the reduction motor through the electric wire 41. An electric switch is provided on the electric output end of the battery or on the electric wire or on the reduction motor, and is used for controlling operation of the reduction motor. By using the electric reeling device, the bowing efficiency can be further improved and manpower can be saved.

In the multi-shot crossbow of the present application, the number of arrow grooves is limited to ten, to realize the technical effect "ten arrows by one crossbow at a time" of Zhugeliannu. The front end of each hammer is provided with a detachable hammer head 39, by which the hammer head can be conveniently replaced for maintenance and repair.

What is claimed is:

1. A multi-shot crossbow, comprising a crossbow arm, a bowstring, and a crossbow body;

wherein the crossbow arm is provided with a slider which is slidably connected with the crossbow arm along a longitudinal direction of the crossbow arm, a top of the crossbow arm is fixed with an arrow chamber which is provided with a plurality of longitudinally extending arrow holes, a plurality of arrows are arranged in the arrow holes, a plurality of hammers are slidably connected with the plurality of arrow holes in a one-to-one correspondence, the hammers are fixedly connected to the slider and slide with the slider to shoot the arrows simultaneously, each of the plurality of hammers has an arrow hitting end, the arrow hitting ends of the plurality of hammers are located at a same distance from rear ends of corresponding arrows before the hammers are driven to shoot the arrows, the bowstring is located below the crossbow arm, and the bowstring is attached to the slider, and when the slider is at a back end point, the slider is movably attached to the crossbow body.

2. The multi-shot crossbow according to claim 1, wherein the crossbow body has a wrench, a hook plate, and a spring;

an upper portion of the wrench and a middle portion of the hook plate are each hinged on the crossbow arm through a shaft pin;

an elastic end of the spring is crimped to the crossbow arm, and another elastic end of the spring is crimped to the wrench under the shaft pin; and a rear end of the hook plate is movably attached to a middle portion of the wrench, when the slider is at the back end point, the slider is movably attached to a front end of the hook plate.

3. The multi-shot crossbow according to claim 1, wherein the crossbow arm is provided with elongated through holes in a longitudinal direction; and the slider is limited within the elongated through holes and slidably connected to the crossbow arm.

4. The multi-shot crossbow according to claim 1, wherein the slider is slidably connected to the crossbow arm by a slideway; and the slideway is fixed to the crossbow arm.

5. The multi-shot crossbow according to claim 1, wherein the arrow chamber has a base which is provided with a plurality of longitudinally extending arrow grooves;

a plurality of U-shaped arrow sheaths are sequentially stacked on top of each arrow groove, a width of each arrow sheath is greater than a width of each corresponding arrow groove;

a bottom surface of the arrow sheath of a lowermost layer and the corresponding arrow groove form each arrow groove, a front portion of a bottom surface of each arrow sheath is provided with a projection;

a rear end of each hammer or slider is provided with a shaft lever, each shaft lever is provided with a hinged jacking plate, a rear end of each jacking plate under normal state is tilted up to be opposite to the projection of on the bottom surface of the corresponding arrow sheath; and each of the arrow grooves is received in a bottom open box body, the box body is fixed on the base or the crossbow arm, a rear elevation of the box body is provided a plurality of U-shaped gaps corresponding to a position of a section of the arrow sheath of the lowermost layer.

6. The multi-shot crossbow according to claim 1, wherein a front end of a bottom portion of the crossbow arm is provided with an automatic wire spooler, a rear end of a bottom portion of the crossbow arm is provided with a reeling device; and a pull wire is provided between the automatic wire spooler and the reel, the pull wire is attached with a hook, and the hook is movably attached to the slider.

7. The multi-shot crossbow according to claim 6, wherein the reeling device is an electric reel.

8. The multi-shot crossbow according to claim 1, wherein the number of the arrow grooves is ten.

9. The multi-shot crossbow according to according to claim 1, wherein a front end of the hammer is provided with a detachable hammer head.

* * * * *